United States Patent [19]

Dahlgren et al.

[11] Patent Number: 4,533,563

[45] Date of Patent: Aug. 6, 1985

[54] COATING METHOD

[76] Inventors: Harold P. Dahlgren, 4008 Buena Vista, Dallas, Tex. 75205; John W. Gardiner, 2116 Oak Meadows, Bedford, Tex. 76021; James E. Taylor, 4129 Drowsy La., Dallas, Tex. 75233

[21] Appl. No.: 578,659

[22] Filed: Feb. 9, 1984

Related U.S. Application Data

[60] Division of Ser. No. 323,099, Nov. 19, 1981, Pat. No. 4,444,147, which is a continuation-in-part of Ser. No. 282,294, Jul. 13, 1981, abandoned.

[51] Int. Cl.[3] ..... B05D 1/28

[52] U.S. Cl. ..... 427/387; 427/428; 118/261

[58] Field of Search ..... 427/428, 387; 118/261

[56] References Cited

U.S. PATENT DOCUMENTS

| | | | |
|---|---|---|---|
| 3,400,013 | 9/1968 | Harrison | 427/387 |
| 4,057,596 | 11/1977 | Takamizawa et al. | 427/387 X |
| 4,151,344 | 4/1979 | Doss | 427/387 |
| 4,216,252 | 8/1980 | Moeller | 427/428 |
| 4,262,043 | 4/1981 | Wald | 427/387 |
| 4,287,828 | 9/1981 | Dahlgren | 101/352 |
| 4,340,647 | 7/1982 | Eckberg | 427/387 |

*Primary Examiner*—Shrive P. Beck

*Attorney, Agent, or Firm*—Gerald G. Crutsinger; John F. Booth; Monty L. Ross

[57] ABSTRACT

An apparatus for applying silicone polymer coating to a web substrate comprising: a roll having a resilient surface; means to rotate the roll; a metering member comprising a hard, generally flat, elongated metallic strip having first and second polished edges with a relieved area therebetween to prevent engagement of the metering member with a metered film of liquid on the resilient roll surface except by the portion of the metering member lying between the first and second polished edges; means to urge the metering member into pressure indented relation with the resilient surface; and heat exchanger means adjacent the metering member to code the metering member adjacent the metering edge.

12 Claims, 17 Drawing Figures

COATING METHOD

CROSS REFERENCE TO RELATED APPLICATION

This is a division, of application Ser. No. 06/323,099 filed 1/19/81 now U.S. Pat. No. 4,444,147 which is a continuation-in-part of application Ser. No. 282,294, filed July 13, 1981, entitled "Ink Metering Apparatus With Obtuse Metering Member." and now abandoned.

The invention disclosed herein relates to a method and apparatus for applying silicone polymer coating to a web substrate for forming a glaze on the web. The web substrate may comprise paper, foil, Kraft, or any of a number of plastic films, such as polyester, polyethylene, polypropylene, or mylar.

Most coatings such as clay and starch, exhibit Newtonian behavior in that the relaxation time is small compared with time scales of ordinary flows. However, liquid polymers such as silicone polymers, formulated for application to webs of paper and plastic for forming a release or throw-away sheet, exhibit non-Newtonian behavior and slow relaxation effects and even non-linear response to deformation. Characteristically, the viscosity of Newtonian liquids decreases rapidly with an increase of temperature and increases with pressure. However, in the pressure and temperature ranges required in apparatus for applying coating to a web, the viscosity of non-Newtonian liquids is substantially constant until efforts are made to shear the liquid to form a thin film. The silicone polymer exhibits dilatant characteristics in that the viscosity increases and the material acts as a solid as a result of deformation by expansion, pressure or agitation.

Extended blade coaters of the general type disclosed in Stalmuke U.S. Pat. No. 3,230,928 employing a stiff, bevelled blade engaging a web extending around a resilient back-up roll are particularly adapted for applying liquids which exhibit Newtonian behavior for applying high coat weights at high coating solids. Such devices are not suitable for application of a glaze of liquid exhibiting non-Newtonian behavior, such as silicone polymer.

Manufacturers of solventless silicone polymer recommend that the material be applied at 100% solids using a three roll offset gravure coater with differential roll speeds. Typical depositions with a 200 line pyramidal cylinder having a roll speed ratio of 8 to 1 in an offset gravure coater should be about 0.4 pounds of silicone polymer per 3,000 square feet of substrate material. If the roll speed ratio is changed to 4 to 1, the coat weight should be about 0.7 pounds per 3,000 square feet.

The cylinders used in rotogravure coaters are generally mechanically engraved. As lower coat weights are required, finer engraved cylinders are used along with coatings of lower viscosity. As more coating weight is required, coarser screens and higher viscosity coatings are used. Thus, for making significant changes in coat weight, changing the engraved gravure cylinder is necessary. In addition, the engraving covers the entire width of the cylinder and generally requires the use of an impression cylinder behind the web which is substantially equal to the width of the web. Some paper converting machines are equipped with several spare rubber rolls of varying widths for use with webs of different widths.

In addition to rotogravure, reverse roll coaters and wire wound roll coaters have been used with limited success for application of silicone coating.

The wire wound roll is not suitable for (light gauge extensible) films, low tensile strength papers or easily abraded substrates. The wire wound rods can cause scratching of the coating or the substrate.

Reverse roll coaters of the type disclosed in Montgomery, U.S. Pat. No. 2,676,563 and metering devices of the type disclosed in Dahlgren U.S. Pat. No. 3,647,525 may be employed for applying coatings having less than about 60% solids. However, such equipment is not capable of applying very low coating weight 100% solids silicone material to a web.

One hundred percent solids silicone polymer is an expensive coating material which is often applied in a short run operation to a web which is for example 75 to 80 inches wide. Because different tapes have different pressure sensitive adhesives, release problems between the silicone coated backing paper and the pressure sensitive adhesive will vary from application to application. Thus, in view of the short runs, the formulation of coating will be changed often.

Rotogravure coating machines may require as much as 15 gallons of coating to submerge the roll to apply coating to a web. Since the cost of silicone coating may vary from about $7 to $14 per pound and weighs 8.0 to 9.3 pounds per gallon, the cost of a gallon of silicone resin might be for example $100 per gallon. If 15 gallons is required to initiate a coating operation, it will be readily apparent that the minimum cost of start-up for any run would be about $1,500.

Silicone coating machines must be cleaned carefully because residue of the old batch of coating material will contaminate a new batch of coating material having a different formulation. Further, it is difficult to clean engraved rolls in a rotogravure type coating system.

The invention disclosed herein permits application of a thinner glaze of silicone polymer to a web substrate than has been accomplished heretofore; permits adjustment of coat weight without changing or replacing rolls; permits application of coating to webs of different widths without changing or replacing rolls; utilizes only a small volume, for example, one pound of silicone polymer for initiating a short run; and greatly reduces the effort required for cleaning the coating apparatus in preparation for application of coating having a different formulation.

SUMMARY OF INVENTION

The coater apparatus employs a metering member having a flat, metering surface inclined at an angle of about 50° from a plane tangent to a resilient roll surface and terminates at an apex at its lower end. The metering surface is quite short, for example, about 0.050 inches so that coating material carried by the resilient roll surface will impinge against the metering surface, a portion of the coating being carried through a metering wedge between the edge on the metering member and the resilient roll surface and the remainder of the coating material flowing away from the roll surface and about the metering surface. A heat exchanger is positioned adjacent the metering surface for maintaining the temperature of the silicone polymer less than about 100° Fahrenheit and preferably less than 75° Fahrenheit.

The resilient surface of the transfer roll is urged into engagement with a web substrate which is moved at substantially the same surface speed as the resilient surface roll. It is important that the resilient surface on the roll be deformed by the web so that portions of the roll surface will be conformed to the configuration of the web for application of coating over peaks and valleys in the surface of the web to form a very thin glaze of silicone material on the surface of the web while minimizing the thickness of the glaze. A back-up roll provides support for the web to apply pressure of the web against the resilient transfer roll surface.

A primary object of the invention is to provide an improved method of applying a 100% silicone reactive polymer of polydimethylsiloxane and a cross-linker to a web in the form of a very thin continuous glaze while minimizing the coat weight.

Another object of the invention is to provide coating apparatus capable of metering very thin films of coating material and applying the coating material to a web substrate while minimizing the volume of coating material which must be deposited in the reservoir of the coater.

Another object of the invention is to provide an improved coating apparatus incorporating an improved metering member particularly adapted for metering non-Newtonian liquids and applying a film of the non-Newtonian liquid to a web substrate.

A further object of the invention is to provide coating apparatus comprising a pair of rolls between which webs of varying width may be moved without changing the roll which applies coating to the web or the back-up roll when a web of a different width is to be coated.

A still further object is to provide an abbreviated coating system of one roll and one metering member whenever the metering member is shaped and positioned such that changes in coating speeds do not affect coat weight.

Other and further embodiments of the invention will become apparent upon referring to the detailed description hereandafter following and to the drawings annexed hereto.

DESCRIPTION OF DRAWING

Two embodiments of the invention are illustrated in the attached drawing, in which.

Numeral references are employed to designate like parts throughout the rest of the figures in the drawing.

DESCRIPTION OF A PREFERRED EMBODIMENT

Figure 1:
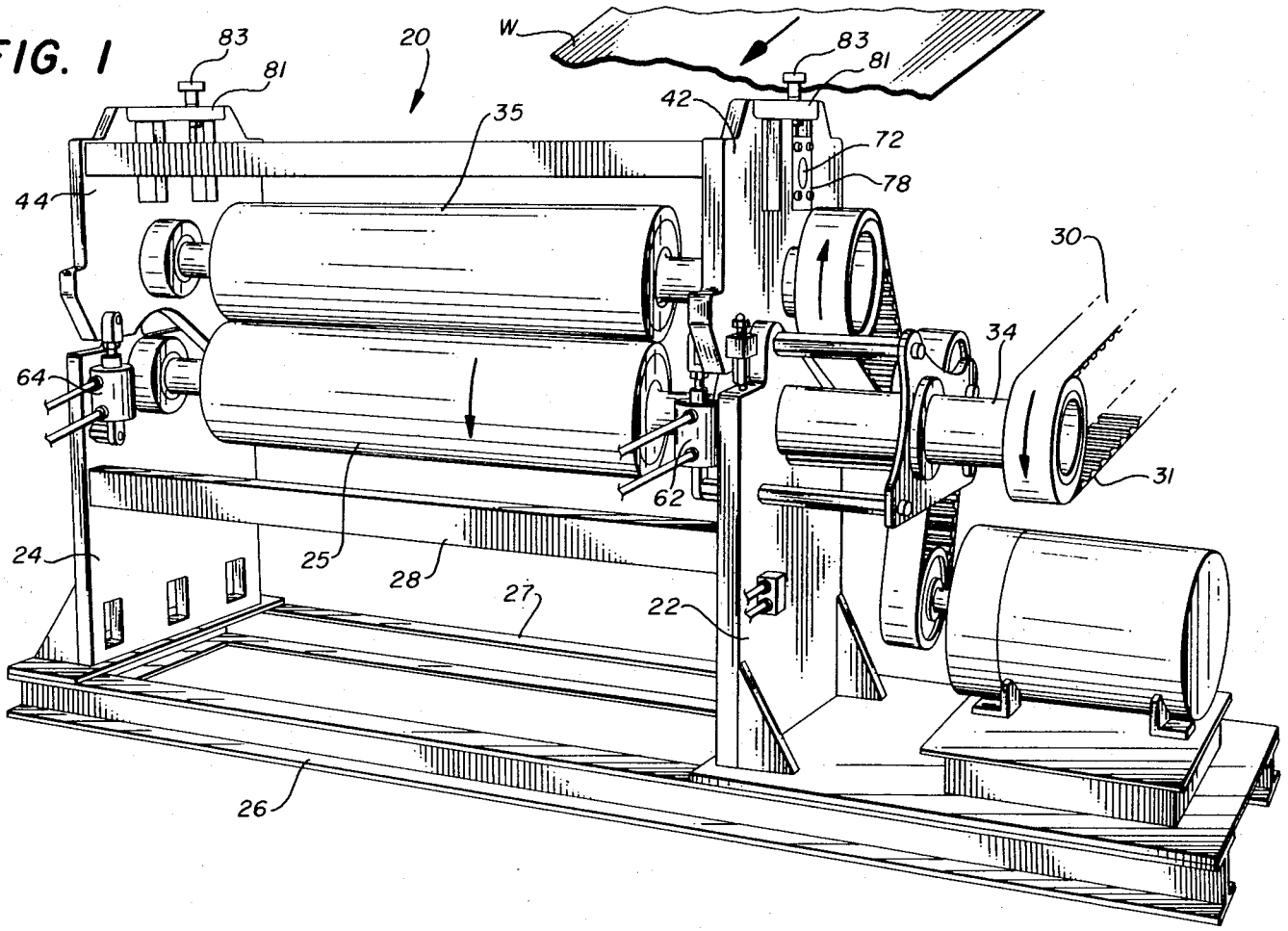
FIG. 1 is a perspective view of the drive side and the rear of the coating apparatus.
Figure 2:
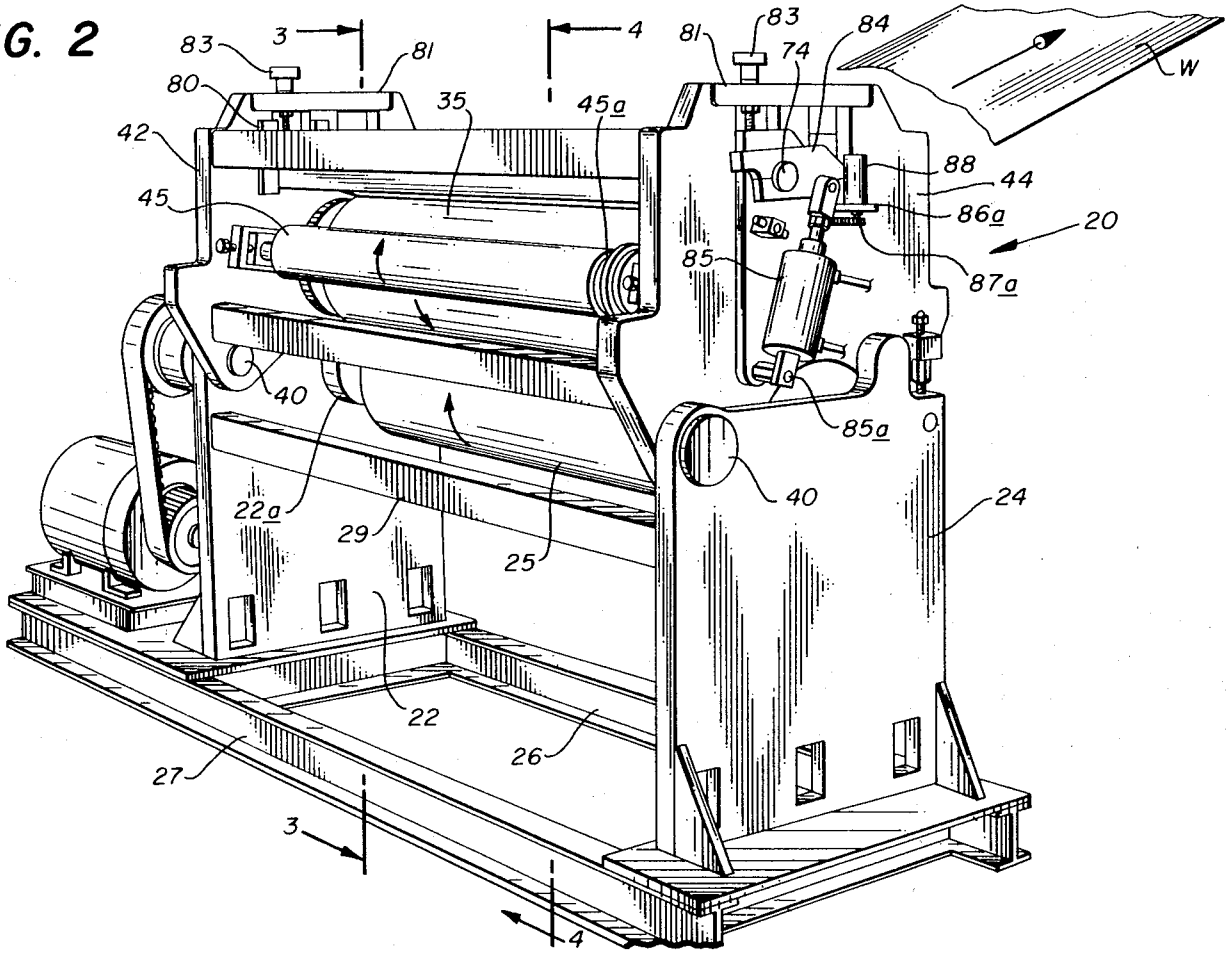
FIG. 2 is a perspective view of the tending side and the front of the coating apparatus.
Figure 3:
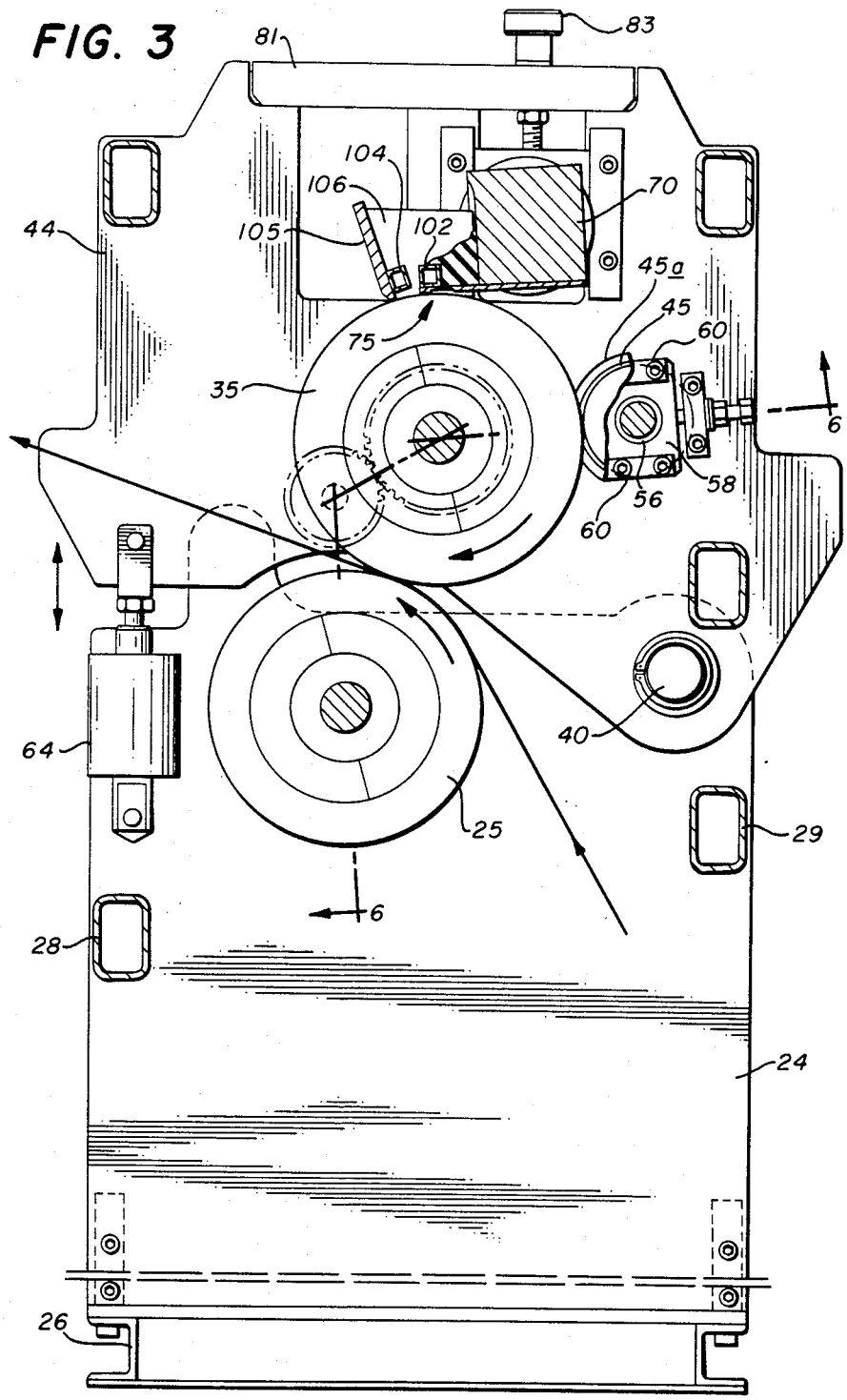
FIG. 3 is a cross sectional view taken along line 3—3 of FIG. 2.

Referring to FIGS. 1 and 2 of the drawing, the numeral 20 generally designates a coating apparatus having spaced support frames 22 and 24 on the drive side and the tending side, respectively. As we will more fully explain, back-up roll 25 is rotatably secured between the support frames 22 and 24 and adjacent transfer roll 35. As best illustrated in FIG. 3 of the drawing, smoothing roll 45 and a metering member 55 are positioned about the surface of transfer roll 35.

As best illustrated in FIGS. 1–4 of the drawing, support frames 22 and 24 are secured to base members 26 and 27; and brace members 28 and 29 extend between the support frames to form a strong rigid structure.

As best illustrated in FIGS. 3, 4, 5 and 6, opposite ends of back-up roll 25 are rotatably secured in bearing housings **22*a* and 24*a* secured to support frames 22 and 24, respectively. Means is provided for rotating back-up roll 25 such that its surface speed will be equal to the surface speed of web W of substrate material. In the illustrated embodiment of FIG. 5, a belt 30, which may be driven by any suitable source of power, such as a line shaft, drivingly engages a pulley 31 keyed or otherwise secured to a drive shaft 32 which is connected through a flexible coupling 33 to the journal 25*a* on one end of back-up roll 25. The journals 25*a* and 25*b* on the ends of back-up roll 25 are preferably supported in spherical roller bearings 22*a*′ and 24*a*′ and journal 25*a* is driven through flexible coupling 33 to accommodate any slight misalignment of the axes of drive shaft 32 and back-up roll 25. A sleeve 34 is bolted or otherwise secured to the drive side support frame 22 and has bearings mounted therein or supporting drive shaft 32**.

Figure 12:
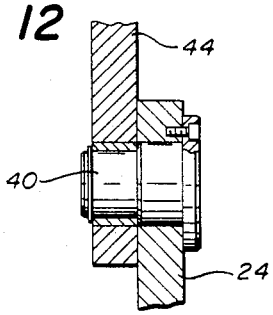
FIG. 12 is a cross section view taken along line 12—12 of FIG. 7.

As best illustrated in FIGS. 3, 4, 5, 6, 7 and 12, side frames 42 and 44 are pivotally secured to support frames 22 and 24, respectively, by pins 40. As illustrated in FIG. 12, pins 40 are supported by support frames 22 and 24 and are fixedly secured thereto, for example, by bolts. Each pin 40 extends into an opening in side frames 42 and 44 which rotate about the axis of pin 40.

Figure 5:
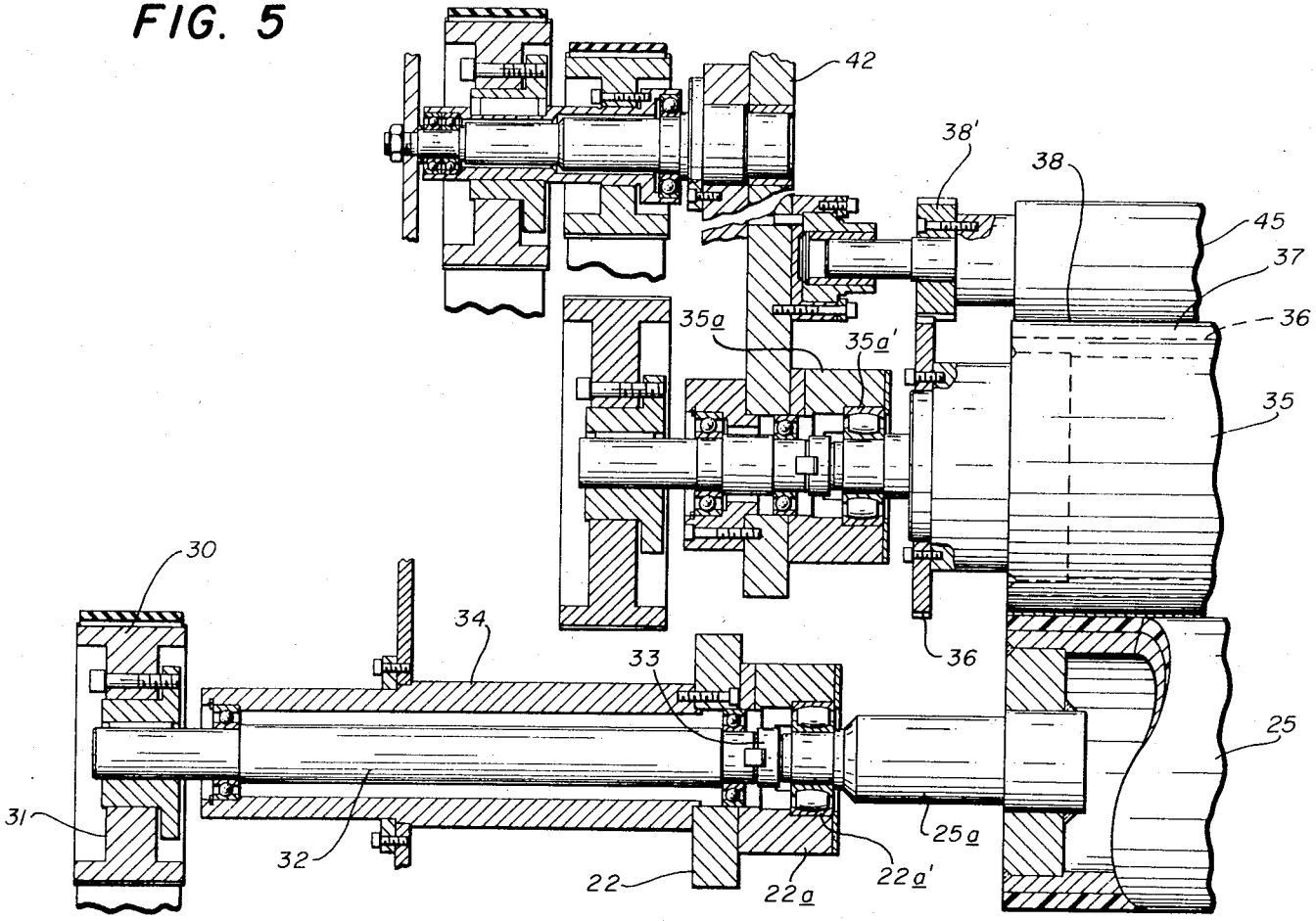
FIG. 5 is a cross sectional view taken along line 5—5 of FIG. 4.
Figure 6:
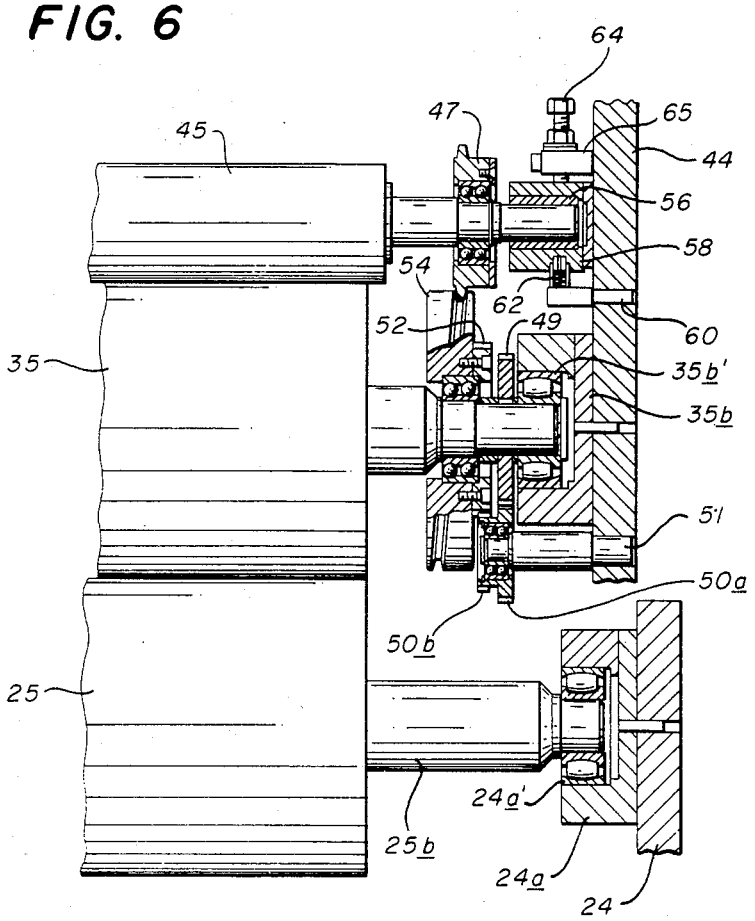
FIG. 6 is a cross sectional view taken along line 6—6 of FIG. 3.

As best illustrated in FIGS. 5 and 6 opposite ends of transfer roll 35 are rotatably secured to side frames 42 and 44 in bearing housing **35*a* and 35*b*, respectively, so that transfer roll 35 is movable about the axis of pins 40 when side frames 42 and 44 are moved relative to support frames 22 and 24**.

The transfer roll 35 comprises a hollow, rigid, tubular metallic core 36 having a resilient non-absorbent cover 37 secured thereto, the cover having a uniformly smooth, uniformly textured, and resilient outer surface 38. The cover 37 on transfer roll 35, while being resilient, is relatively firm, for example, in a range between 40 and 70 Shore A durometer.

The cover 37 on transfer roll 35 is preferably formed of a resilent urethane, polyurethane, rubber or rubber-like material attached to a metallic core 36. Preferably the cover is made from Buna Nitrile rubber which provides a natural surface having microscropic pores to receive and hold silicone coating material therein to enable metering a thin silicone coating film material suitable for fine coating applications.

The cover 37 on transfer roll 35 should have high tensile strength, excellent tear, scratch and abrasion resistance, and resistance to oils, solvents and chemicals. The cover should, furthermore, have low compression set, good recovery, and uniform silicone coating material receptivity. A suitable cover can be formed using urethane or rubber to form a resilient cover preferably of about 60 Shore A durometer.

A suitable urethane cover may be made from a blocked, pre-catalized material which is commercially available from Arnco in South Gale, Calif., under the trademark "Catapol". The material is pre-heated at 160° F. for five hours, poured into a mold around the roll core, and then heated to 280° F. for 8½ hours, and allowed to cool prior to grinding and polishing.

A suitable rubber cover may be obtained from Mid-America Roller Company, Arlington, Tex., and specified as Buna-Nitrile which is conventionally formed over the core and ground with a high-speed grinder prior to polishing.

After a resilient cover 37 of either urethane or rubber has been formed, the roll may have a slick glazed outer skin or film over the surface thereof which is removed by grinding. After grinding with a 120 grit rock, the surface of resilient cover 37, if constructed of urethane, is sanded by using 180 grit sandpaper to form a surface of uniform smoothness over the surface 38 of the resilient cover 37. However, after grinding with a 120 grit rock, the surface of resilient cover 37, if constructed of rubber is sanded with 350 grit sandpaper to insure a velvet smooth, uniformly textured surface, free of "orange peel" or other surface irregularities.

Microscopic reservoirs into which silicone coating material is attached, help to assure that a continuous unbroken film of silicone coating material is maintained on the surface 38 of transfer roll 35.

Surface scratches, grind lines, and other surface irregularities should be removed so that the surface roughness of the surface of either urethane or rubber after sanding does not exceed 30 RMS. As will be hereinafter more fully explained, adhesive force between molecules of silicone coating material and molecules of the surface 38 of cover 37 must exceed cohesive force between silicone coating material molecules to permit shearing the silicone coating material to form a controlled, continuous, unbroken film of silicone coating material on the surface 38 of transfer roll 35.

It will be appreciated that it is physically impractical, if not impossible, to construct and maintain roll 35 such that surface 38 is perfectly round in a circumferential direction, perfectly straight in a longitudinal direction, and precisely concentric to the axis of core 36. The straightness or waviness of surface 38 on roll 35 can be economically manufactured within a tolerance of about 0.002 inches along the length of roll 35 and the radial eccentricity can be economically manufactured within a tolerance of about 0.0015 inches.

A Shore A durometer test is generally used to indicate the hardness of a resilient roll cover by measuring resistance to penetration at a constant temperature of about 76° F. while the resilient cover is stationary. The apparent hardness of a resilient surface under dynamic conditions deviates radically from the hardness indicated by the durometer test under static conditions. The spring constant of a resilient material so increases slightly as deformation increases.

As the frequency of loading of a resilient member increases, the dynamic modulus or apparent modulus of elasticity increases causing the cover to appear as a harder, stiffer material. However, cyclic loading of a resilient member results in generation of internal heat which increases temperature and results in a decrease in the durometer and therefore the modulus of elasticity of the resilient cover.

Back-up roll 25 and smoothing roll 45 preferably have resilient surfaces and are substantially identical to transfer roll 35, except that smoothing roll 45 preferably has a diameter which is significantly less than that of transfer roll 35. However, back-up roll 25 and smoothing roll 45 may be provided with surfaces constructed of different materials and may be harder and thinner if convenient to do so.

As best illustrated in FIG. 5 of the drawing, a gear 46 is secured to transfer roll 35 and is disposed in meshing relation with a gear 38 secured to the end of smoothing roll 45. Thus, smoothing roll 45 is positively driven at substantially the same surface speed as metering roll 35.

As best illustrated in FIG. 6, a gear 49 is secured to the journal of transfer roll 35 and is disposed in meshing relation with the larger gear 50*a* of a compound gear mounted on a stub shaft 51 secured to side frame 44 of the coater. The smaller gear 50*b* on the compound gear is in meshing relation with a gear 52 which is bolted or otherwise secured to a cam plate 54 secured by bearings about the journal on the end of transfer roll 35. Thus, it should be readily apparent that rotation of metering roll 35 imparts rotation through gear 49, gears 50*a*, 50*b* and 52 to cam 54 which has a groove formed in its outer surface. Cam 54 rotates at a surface speed different from that of transfer roll 35 because gears 49 and 52 have different pitch line diameters, and, the gears 50*a* and 50*b* have different pitch line diameters.

A cam follower disc 47 is rotatably secured to the journal on the end of smoothing roll 45. However, as illustrated in FIG. 6, cam follower plate 47 is captured between a shoulder and a snap ring on the journal of vibrator roll 45 such that movement of the follower 47 imparts axial oscillation to smoothing roll 45.

As best illustrated in FIGS. 3 and 6 of the drawing opposite ends of smoothing roll 45 are rotatably secured in bearings 56 mounted in slide blocks 58 which slide in grooves between retainer plates 60. Each slide block 58 is urged in a direction away from the surface of metering roll 35 by a spring 62. A pressure adjustment screw 64 is threadedly secured to support bar 65 and engages the upper surface of slide block 58. Thus, the stripe between transfer roll 35 and smoothing roll 45 is adjustable by rotation of screw 64.

As best illustrated in FIGS. 2, 5 and 6, the resilient cover 45*a* on smoothing roler roll is cut away so that the cover is shorter than the distance between end dams 500, as will be more fully explained.

As best illustrated in FIG. 1 of the drawing, a pair of air cylinders 62 and 64 are secured between support frames 22 and 24 and side frames 42 and 44, respectively for movement of side frames 42 and 44 relative to support frames 22 and 24.

Figure 4:
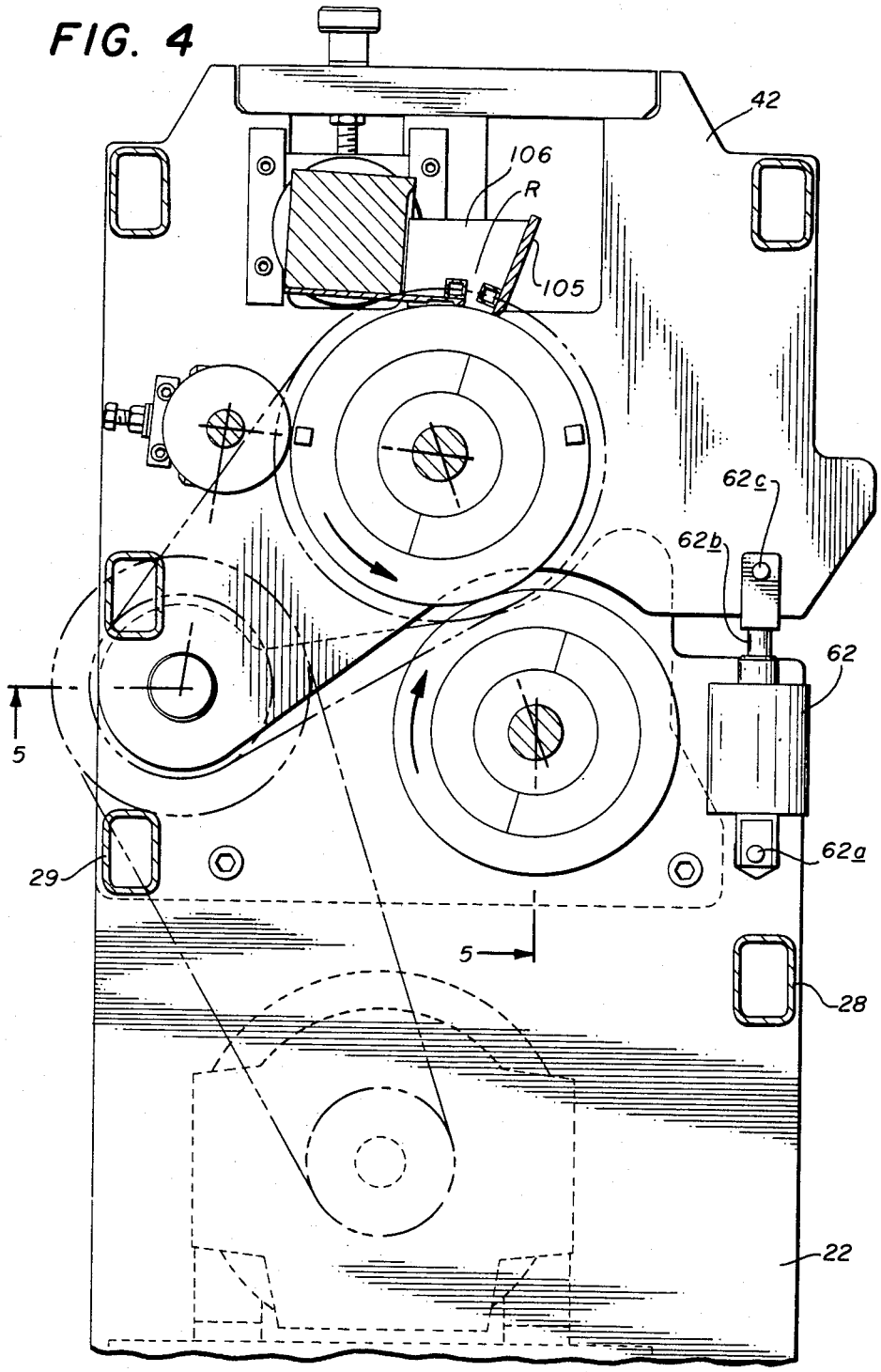
FIG. 4 is a cross sectional view taken along line 4—4 of FIG. 2.

Air cylinder 62 is secured by a pin 62*a* to support frame 22 and the rod 62*b* is secured by a pin 62*c* to side frame 42 as seen in FIG. 4.

Figure 7:
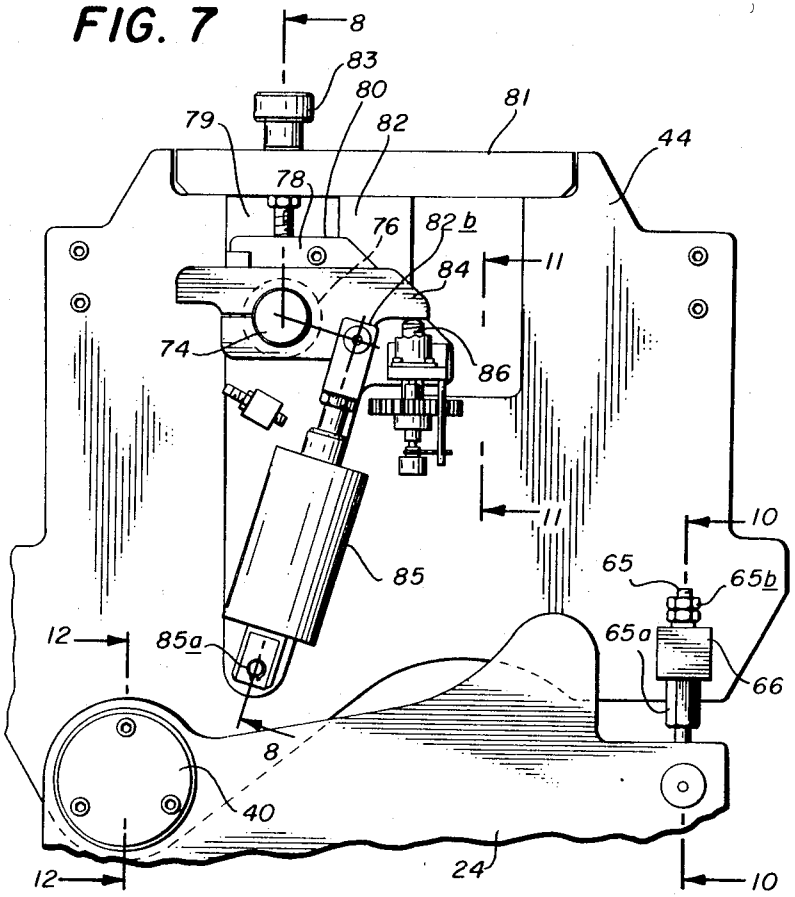
FIG. 7 is an enlarged fragmentary view of the tending side of the coating apparatus.
Figure 9:
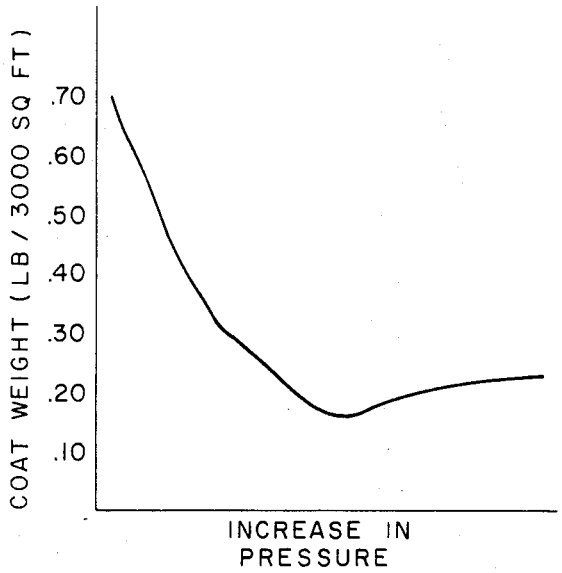
FIG. 9 diagrammatically illustrates coat weight change resulting from changes in indentation of the metering member into the transfer roller surface.
Figure 10:
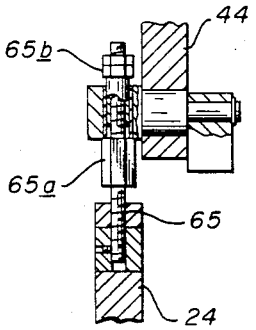
FIG. 10 is a cross section view taken along line 10—10 of FIG. 7.

As best illustrated in FIGS. 1, 7, and 10, pressure adjustment screws 65 are pivotally secured to support frames 22 and 24 and extend through sleeves 66 on side frames 42 and 44. Lock nuts 65*a* and 65*b* are positioned on screw 65, as illustrated in FIG. 7, to permit limited movement of side frames 42 and 44 relative to support frames 22 and 24 when cylinders 62 and 64 are actuated.

Figure 8:
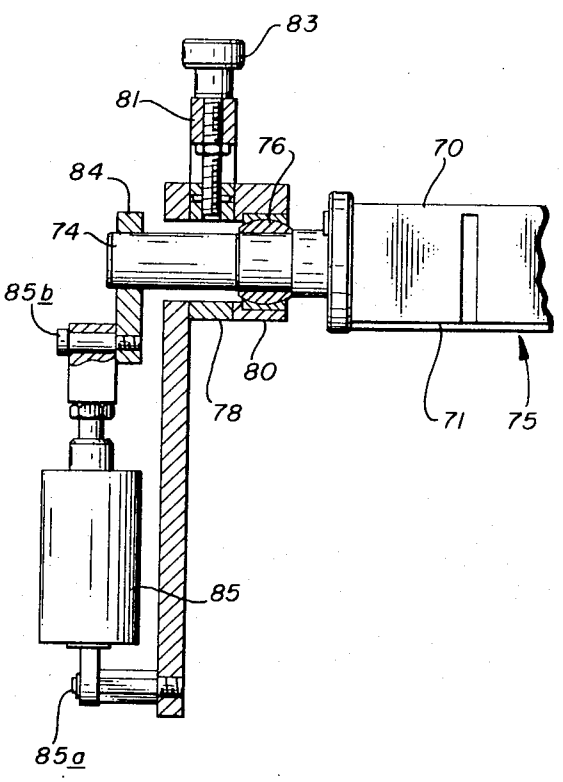
FIG. 8 is a cross section view taken along line 8—8 of FIG. 7.

Support means for metering member 15 is illustrated in FIGS. 7 and 8 of the drawing. Metering member 75 is secured to a rigid support bar 70 having a ground and true face 71 on one side thereof and having journals 72 and 74 extending outwardly from opposite ends thereof. As best illustrated in FIG. 8 of the drawing, each of the journals 72 and 74 has a flange formed on one end thereof which is bolted or otherwise secured to the rectangular shaped support bar 70.

The journals 72 and 74 are rotatably secured in self-aligning bushings 76 in faceplates 80 which are bolted or otherwise secured to guide blocks 78 which are slidably disposed in slots 79 in side frames 42 and 44.

As best illustrated in FIG. 7 of the drawing, a cap 81 has opposite ends bolted or otherwise secured adjacent opposite sides of slot 79 in side frames 42 and 44 and has a central post 82 extending downwardly therefrom, the lower end of which is bolted or otherwise secured to the side frame 42 or 44.

A pressure adjustment screw 83 is threadedly secured through a threaded opening in cap 81 and has a lower end rotatably secured to guide block 78. Thus, rotation of pressure adjustment screw 83 imparts vertical motion to guide block 78 and faceplate 80 for moving support bar 70 and metering member 75 relative to the surface 38 of cover 37 of transfer roller 35.

Cap 81 and post 82 may be disengaged from side frames 42 and 44 to permit reversing the direction from which metering member 75 extends outwardly from support bar 70, if it is deemed expedient to do so. When thus reversed, support bar 70 would be moved from the position illustrated in FIG. 3 of the drawing, wherein it lies on the right side of the axis of transfer roll 35, to a position in which it would be positioned on the left side of the axis of applicator roller 35 as viewed in FIG. 3. Referring to FIGS. 2 and 7 of the drawing, the journal 74 on the tending side of the coating apparatus has a crank arm 84 keyed or otherwise secured thereto. An air cylinder 85 is pivotally secured by a pin 85*a* to the side frame 44 on the tending side of the coating apparatus and has a rod pivotally secured by a pin 82*b* to crank arm 84 for rotating crank arm 84 and support bar 70 relative to side frames 42 and 44 for adjusting indentation of metering edge 90 into the resilient surface 38 on transfer roll 35.

Figure 11:
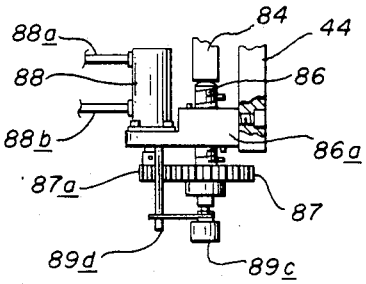
FIG. 11 is a cross section view taken along line 11—11 of FIG. 7.

As best illustrated in FIGS. 2, 7 and 11 of the drawing, an on-stop screw 86 is threadedly secured to a support member 86*a* bolted or otherwise secured to the tending side side frame 44. On-stop screw 86 has a gear 87 secured to the lower end thereof which is driven by a gear 87*a* on the drive shaft of a motor 88 which is also secured to support member 86*a*. Thus, when motor 85 is energized, on-stop adjustment screw 86 will be rotated thereby limiting movement of crank arm 84 for establishing indentation of metering edge 90 on metering member 75 into the surface 37 of transfer roll 35.

From the foregoing it should be readily apparent that in the embodiment of the invention illustrated in FIG. 11 of the drawing, on-stop adjustment screw 86 is remotely controlled by the direct current electrically driven motor 88. Gears 87 and 87*a* form a gear reducer to control the speed or rotation of adjustment screw 86. Motor 88 is commercially available from Globe Industrials Division of TRW, Inc., of Dayton, Ohio.

Conductors 88*a* and 88*b* extend between motor 88 and a motor position control unit 89 which comprises essentially a source of direct current electricity and a three position switch including an off position and two positions for rotating motor 88 in opposite directions.

The motor position control unit 89 preferably has a digital readout indicator 89*a* associated therewith to indicate the position of a rotary potentiometer 89*c* secured to the end of on-stop adjustment screw 86 which engages an arm 89*d* secured to support member 86*a* to provide a visual indication of the position of crank arm 84 and, consequently, the position of support member 70 and metering edge 90 on metering member 75. The output terminals of the potentiometer are connected to a digital readout device calibrated to indicate the position of metering edge 90 and consequently the thickness of the film of coating applied to the web. Motor 88 may be manually or automatically energized to change the coat weight applied to the web.

Figure 13:
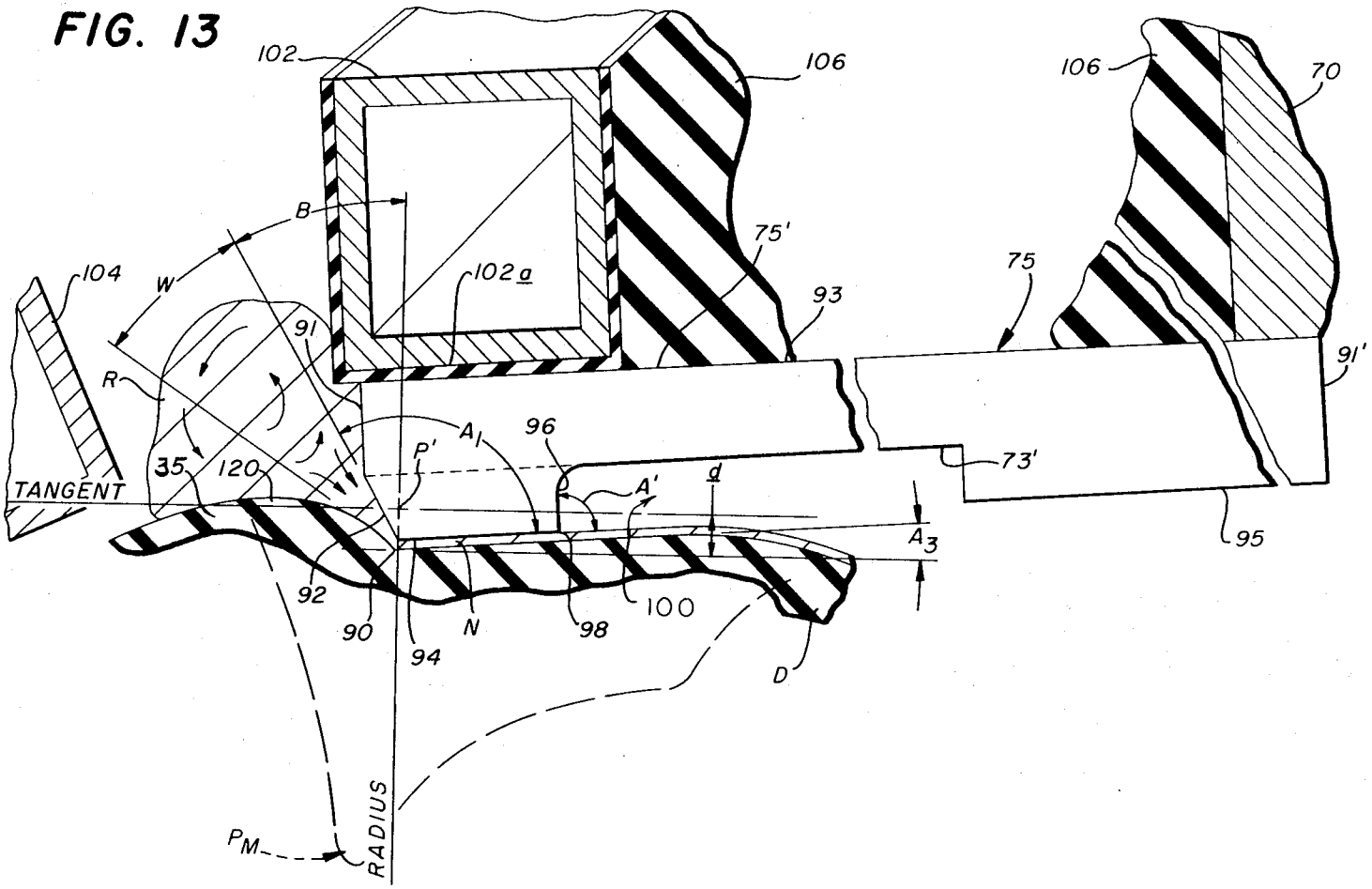
FIG. 13 is an enlarged fragmentary cross sectional view of the trapizoidal shaped metering portion on the working end of the metering member.

Referring particularly to FIG. 13, the silicone coating metering member 75 has a smooth, polished, highly developed, precision metering edge 90 which is formed at the juncture of metering surface 92 and support surface 94.

Metering edge 90 preferably extends in length for a distance within a range of from 75 to 80 inches, depending upon the maximum web width, and is defined by the intersection of the polished surfaces 92 and 94. Polished surfaces 92 and 94 meet at an obtuse angle to form a wedge having an included edge bevel angle "$A_1$" which is approximately 135° or greater.

The edge 90 is preferably formed on relatively hard metallic material having a hardness of about Rockwell C48-50 or higher. It is important that the polished edge 90, metering surface 92, support surface 94, trailing surface 96 and trailing edge 98 be wear resistant since they are indented into the resilient surface 38 of transfer roll 35 during normal operating conditions.

Metering member 75 is preferably a resilient, i.e., flexible, metallic, material having a modulus of elasticity of approximately 30×106 psi, or less, to provide what might be termed a "stylus effect" to the metering edge 90 as the transfer roll 35 rotates. As will be hereinafter more fully explained, cooling tube 102 is supported to transfer heat from metering edge 90 without disrupting this "stylus effect."

Metering member 75 has been formed with good results from a strip of stainless spring steel with sheared edges which is commercially available from Sandvik Steel, Inc., Benton Harbor, Mich., and distributed as Sandvik 7C27MO2. The strip of stainless steel was selected for its hardness, flatness, resilience, grain structure and fine surface finish to provide high wear resistance and good fatigue properties. The stainless steel strip had a thickness of 0.070 inches and a width of approximately 5.3 inches. The strip of material had been heat treated and had a bright polished surface finish, extra accurate flatness and normal straightness. The tolerance of the width was ±0.016" and the tolerance of the thickness was ±0.00181 inches. The strip of stainless steel material is resistant to corrosion in the presence of air, water and most organic acids in dilute form at room temperature.

Initially, the edge, at the juncture of surfaces 91 and 94, had ragged notches forming a ragged edge contour. To form a precision straight edge to define an unbroken line across the extent of metering member 75, surfaces 92 and 94 were ground at a specified obtuse angle, then finished with a fine-grit stone as will be hereinafter more fully explained, as a first step in forming polished edge 90. The strip was then clamped in a special fixture. Surface 92 on the strip was superfinished at the specific angle by hand with a fine grit stone and then hand polished with 600 grit sandpaper.

As a final step, the stainless steel strip was positioned on a flat horizontal surface. Surface 94 was then superfinished by hand with a stone having a fine grit and hand polished with 600 grit sandpaper.

If a feather edge forms on the metering member while portions of surfaces 92 and 94 are being superfinished and polished, the feather edge should be removed with leather or a polishing material. When the feather, or wire-like irregular edge is removed, a smooth, continuous, uniform, blemish-free edge is formed on the strip. Thus, in the process of polishing or "sharpening" the obtuse edge 90, the acuteness of the edge may be altered somewhat to form a non-cutting, non-film-piercing edge. This process produces a fine, continuous, smooth, straight, polished, highly developed, uniform, superfinished, edge 90, having minimal surface irregularities. There should be no small notches or protrusions in the edge. The developed edge 90, formed by polished surfaces 92 and 94, is an extremely fine edge which has been polished to bring it to a highly developed finish, and as nearly perfect condition as possible. Surfaces 92 and 94 are preferably finished to an RMS reading not exceeding RMS 4. The term "superfinishing" as used herein applies to a surface which has been ground and polished such that the peaks of the surface have been removed to form flat bearing surfaces, yet still having minute valleys or reservoirs for accepting and carrying the lubricant silicone coating.

Edge 90 is finished to a surface finish approximating that of the edge of a razor blade. However, it will be appreciated that the obtuse angle "$A_1$" between surfaces 92 and 94 is significantly greater than the bevel angle on a razor blade and thus an obtuse, blunt, non-cutting and non-piercing edge is formed. Actually, surface 92 blends into surface 94 through edge 90 to form a continuous polished surface adjacent each side of edge 90.

An edge radius of less than about 0.003 and preferably about 0.001 is therefore formed as previously described to provide no significant radius or curvature at the interection of surfaces 92 and 94 at edge 90.

The material used to form the edge 90 must not only be hard and capable of being formed to provide a blunt, fine, polished, unbroken, edge, but the material must also be dense yet flexible along the length of the edge 90. In fact, the edge 90 must be quite flexible in a lengthwise direction so that when urged into pressure indented relation with the resilient surface of metering roll 35, the edge 90 will be flexed, yielding to the influence of the surface of roll 35, to conform the edge 90 and the surface of roll 35 to form a substantially uniform indented area along the length of roll 35. As will be hereinafter more fully explained, the resilient cover 37 on roll 40 has a thickness in the range of approximately $\frac{3}{8}$ to $\frac{5}{8}$ inches, preferably $\frac{1}{2}$ inch, and a resilience of about 35 to 70 Shore A durometer, preferably 60 durometer, Shore A. This loading of edge 90 to obtain conformation with the surface of roll 35 should be possible without excessively indenting the surface of the roll when in a dynamic, running condition.

The edge 90 on metering member 75 should be mounted so that it is resiliently urged toward the surface of the transfer roll 35 and is free for movement along its entire length in a direction radial to the transfer roll. Also, the edge 90 must be rigidly supported in a direction substantially tangent to the transfer roll surface.

The ideal support for the edge 90 is a flexible cantilever beam which supports the edge 90 and provides the required bias and rigidity. Although the edge 90 may be a part of a separate trapezoidal like element, which is functionally associated with a cantilever beam, it is preferable to form the edge 90 of the trapezoidal portion 75 on the beam so that the two are an integral unit. To accomplish this, the beam must be flexible in two directions; namely, along the length of the edge 90 and also along the width of the strip, i.e., the length of the cantilever beam.

The silicone coating metering member 75 illustrated in FIG. 13 of the drawing, wherein the edge 90 is formed on the unsupported end 75' of the cantilever beam, has a substantially rectangular cross section bounded by front and rear edge surfaces 91 and 91', upper surface 93 and lower surface 95. Support surface 94 lies substantially in the plane of surface 95, when the cantilever beam is in a non-flexed condition. Metering surface 92 and support surface 94 intersect forming an obtuse angle "$A_1$" and intersect at an apex 90, which is substantially a straight line.

As a example, the cantilever beam which includes the obtuse edge 90 may be formed from a thin, flexible, elongated stainless steel strip or band, as hereinbefore described, having a thickness of 0.070 inches and a width of 5.3 inches, or less. The width of the beam, or the length of the strip of material, will preferably be within the range of from 15 to 80 inches, and the beam is supported to be flexible along the length of edge 90 as well as along the length of the cantilever beam. The modulus of elasticity E of the beam may be, for example $30\times106$ psi, which represents the stiffness of the material; that is, its resistance to deformation. When combined with the moment of inertia I, the EI factor represents the stiffness of the cantilever beam.

The specific dimensions and characteristics of the metering member 75 are presented by way of explanation, and such dimensions, characteristics and mounting may vary to meet specific conditions. Consequently, preferable ranges have been provided herein.

Metering member 75 also has a groove or relieved area 100 formed in the lower surface 95 of the strip of material from which metering member 75 is formed.

The portion of the strip of material which will be polished to form polished edge 90 is masked and the metallic material adjacent thereto is removed by grinding or by chemically milling to remove a portion of the metal without creating stresses that would cause the strip of material to warp.

Surface 96 adjacent the support surface 94 is smoothed by finish grinding to remove approximately 0.003 inch of rough surface material. Surface 96 may then be sanded with 600 grit paper to provide a very smooth surface finish on the surface of 96. Edge 98 is therefore formed as discussed previously for edge 90.

If the thickness, the distance between surfaces 94 and 93, of the strip of material is 0.0070 inches, the depth of the relieved area 100 is preferably greater than 0.020 inches, for example, 0.035 inches, such that the thickness of the material between surface 93' and surface 93 is approximately 0.035 inches.

Surface 96 intersects the polished surface 94 at an angle A' in a range between 30° and 90° as shown. The upper portion of surface 92 of metering member 75 may extend to surface 93 or be bevelled as shown at an angle to form surface 91.

Surface 92 may therefore be only a small chamfer on original surface 91. Obtuse angle "$A_1$", not only forms a metering member having a blunt, obtuse, edge which is not fragile, but, primarily is specifically formed to a particular angle, or configuration, to enable the metering of a specific silicone coating film thickness having a specific viscosity to meter the film without an immediate change in direction of the roll surface and without significant indentation of the roll cover which causes rapid wear of the metering member edge and the roll cover.

In the illustrated embodiment of metering member 75, polished surface 92 extends upwardly from polished edge 90 a distance approximately equal to the depth of relieved area 100, or greater, to intersect surface 91. It should be readily apparent that polished surface 94 supports the polished edges 90 and 98. If surfaces 92 and 96 are parallel, surface 94 can be refinished without changing the load bearing characteristics of the polished edge portion 90 of the metering member 75.

Surfaces 94, 92 and 96, and therefore edges 90 and 98, are readily renewable. By slightly refinishing support surface 94, both edges may be resharpened simultaneously; or, surfaces 92 and 94 may also be refinished. After considerable usage, a small radius or curve may appear at edge 90 to cause changes in metering characteristics. To avoid replacing the entire metering member, the hereinbefore stated, post-grinding and hand-finishing procedures may be again performed several times before the entire member is replaced. Normally one to three thousandths of an inch is removed from any one surface, depending upon the extent of wear to restore edges 90 and 98.

As illustrated in FIG. 13 of the drawing, cooling tubes 102 and 104 are secured for dissipating heat directly from metering member 75 and maintain temperature of coating material in the reservoir R in a desired temperature range, preferably below 75° Fahrenheit. Cooling tube 102 is bonded to the upper surface 93 of metering member 75 by any suitable, flexible, heat conductive material which is not chemically reactive with the coating material being applied by the coating apparatus. Mastic **102*a* is sufficiently resilient to prevent stiffening of the metering member 75. Tube 120 may be constructed of resilient material so that the metering member 75** will not be stiff.

It is important that tube 102 be bonded directly to the surface 93 of metering member 75 to prevent accumulation of silicone resin between tube 102 and metering member 75. When the resin is maintained at a temperature of, for example, 250° Fahrenheit for a period of time of 20 seconds, the material will become cross-linked which results in the material setting up to form a rubber-like material having high thermal insulating characteristics.

A second tube 104 is secured to dam member 105 and is spaced from tube 102 a distance of at least one-quarter inch to form a vent passage through which air carried by the surface of transfer roll 35 under dam 105 can escape. If tubes 102 and 104 are closely spaced and prevent escape of air entrained in the coating material, air bubbles will be formed which will move through the wedge W, past metering edge 90, so that a non-uniform film of coating material will be formed on the surface of transfer roll 35.

For applying silicone coating with the coating apparatus herebefore described, it is important that a minimum volume of material be maintained in the reservoir R. In the embodiment illustrated in FIG. 13 of the drawing, a foam rubber closure member 106 is positioned between support bar 70 and tube 102 for forming a substantially V-shaped reservoir directing coating material toward the metering surface 92 on the end of metering member 75.

It should be readily apparent that cooling tubes 102 and 104 may be replaced with other suitable heat exchanger apparatus for maintaining the temperature in the region of the wedge W in a required temperature range. In the embodiment illustrated, cooling water, mixed with anti-freeze, is delivered through refrigerating apparatus (not shown) and through cooling tubes 102 and 104 for dissipating heat at substantially the same rate it is generated or delivered to the reservoir R.

Suitable end dams 106 are positioned in sealing engagement with the opposite ends of the surface of transfer roll 35 to contain coating in the reservoir R.

Figure 17:
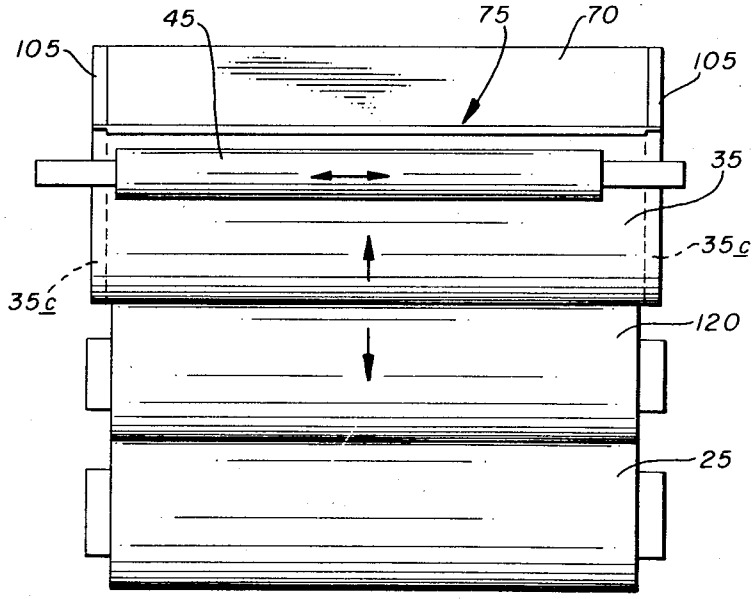

As diagrammatically illustrated in FIG. 17, end dams 105 are spaced apart a distance substantially equal to the length of metering member 75 and are urged into sealing relation with the resilient surface of the roll adjacent opposite ends of transfer roll 35. It has been observed that a bead **35*c* of coating material may be formed about the periphery of metering roll 35 at the junction between end dams 105 and ends of metering member 75**.

The resilient surface on smoothing roller 45 is cut to a length such that the resilient surface on smoothing roller 45 will not engage the bead **35*c* of coating formed on opposite ends of transfer roll 35. Since smoothing roll 45 preferably oscillates in a longitudinal direction, the maximum length of the resilient cover on roll 45 should be equal to the distance between end dams 105 less the length of the stroke through which roll 45 is oscillated. Thus, bead 35*c* is not disturbed by oscillation of smooting roller 45**.

Applicator roller 120 preferably has a maximum length which is less than a distance between end dams 105 so that bead **35*c* on transfer roll 35 will not be transferred to applicator roll 120**.

In the embodiment illustrated in FIGS. 1–13 of the drawing, backup roll 25 would have a maximum length less than the distance between end dams 105 to prevent transfer of the bead **35*c* of excess coating material on the surface of transfer roll 35 to the backup roller 25**.

Figure 16:
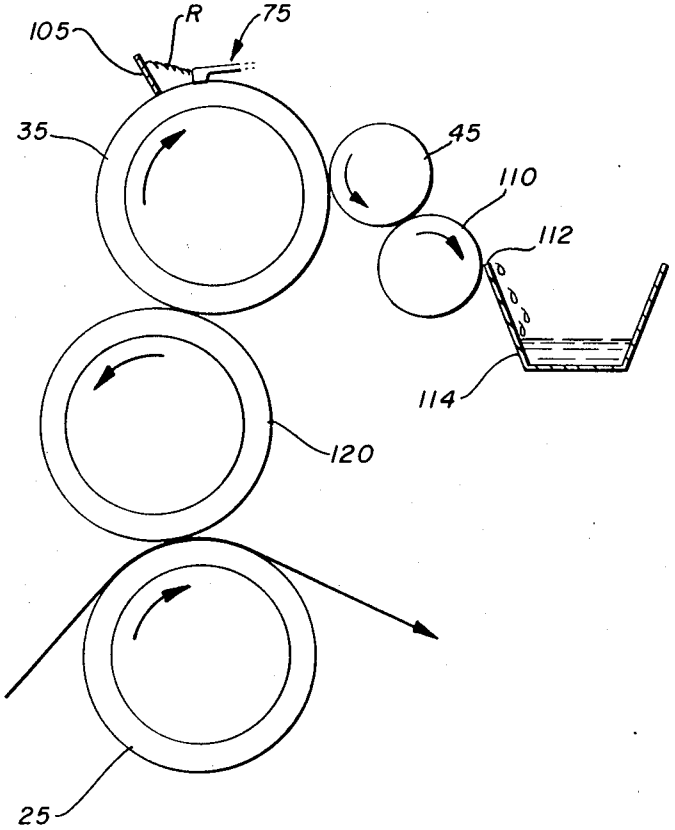
FIG. 16 is a diagrammatical illustration of a second embodiment of the coating apparatus.

A second embodiment of the coating apparatus is diagrammatically illustrated in FIG. 16 of the drawing.

Parts of the second embodiment which are identical to those herebefore described are designated by like numerals in FIG. 16.

A clean-up roll 110 is positioned in engagement with the surface of smoothing roll 45 and has a gear secured to one end thereof for meshing with the gear 46 on the end of smoothing roll 45. Thus, clean-up roller 110 drivingly engages the surface of smoothing roll 45 for removing a film of coating material from the surface of roller 45. A clean-up blade 112 is positioned to engage the surface of clean-up roller 110 for removing a film of coating material from the surface of the clean-up roller and depositing the coating in a pan 114. Thus, for removing coating material from the reservoir R, pressure between metering edge 90 on metering member 75 and surface 38 of transfer roll 35 is reduced to form a relatively thick film of coating material on the surface of transfer roller 35. The thick film is transferred over smoothing roll 45 and clean-up roller 110 and is removed by clean-up blade 112. After substantially all of the coating material has been removed from rolls 35, 45 and 110, a cleaning solution may be applied to the surface of the rolls for removing any residue of the coating previously applied from the roller surfaces.

In the embodiment of the invention illustrated in FIG. 16 of the drawing, an applicator roll 120 is positioned between transfer roll 35 and the surface of the web which is to be coated. Transfer roll 35 is preferably driven by an independent variable speed motor such that the surface speed of transfer roll 35 can be adjusted relative to the surface speed of the applicator roll 35.

The embodiment of the coating apparatus illustrated in FIG. 16 of the drawing is preferably employed for application of coatings such as clay, starch, pressure-sensitive adhesive and other coatings which exhibit the Newtonian behavior. However, it may be used to apply silicone if applicator roll 120 is driven at web speed.

Other aspects of the present invention are further described and explained in copending application Ser. No. 282,294, filed July 13, 1981, which is incorporated by reference herein in its entirety.

SET UP AND OPERATION

The operation and function of the apparatus hereinbefore described is as follows:

Metering member 75 is aligned and bolted or otherwise secured to support bar 70 to form a cantilever having metering edge 90 on the outer end thereof.

Pressure adjustment screw 83 is rotated for positioning support bar 70 and metering member 75 so that the support surface 94 on metering member 75 is substantially tangent to the surface of roll 35 as illustrated in FIG. 3 of the drawing.

Motor 88 is then activated for positioning pressure adjustment screw 83 in a position to obtain the desired indentation of metering edge 90 into the resilient surface of transfer roll 35. It should be readily apparent that when positioned as described above, support surface 94 will be entirely indented into the resilient roll cover, as illustrated in FIG. 13, and that when roller 35 is rotated, no other surfaces on metering member 75 will be engaged by the resilient surface of the roller. Thus, a metering film is formed in the area designated by the letter W in FIG. 13 of the drawing between metering surface 92 and the roller surface as the roller surface moves toward metering edge 90. After passing metering edge 90, the film thickness will not be further reduced, but will separate cleanly from metering member 75 at the trailing edge 98 on metering member 75. Thus, coating material will not tend to accumulate to form droplets on metering member 75 which will destroy the metered film formed on the surface of roll 35. In the embodiment of the invention illustrated in FIGS. 1–13 of the drawing transfer roll 35 is driven at a surface speed equal to the surface speed of the web for application of silicone coatings. In the embodiment of the invention illustrated in FIG. 16 of the drawing, the transfer roll 35 is preferably driven so that slippage will occur between surfaces of applicator roll 120 and transfer roll 35 for adjusting the thickness of the film of coating applied by roll 35 to applicator roll 120. The surface of applicator roll 120 will move in the same direction of the surface of the web to which coating material is applied and at substantially the same surface speed as the web.

Figure 14:
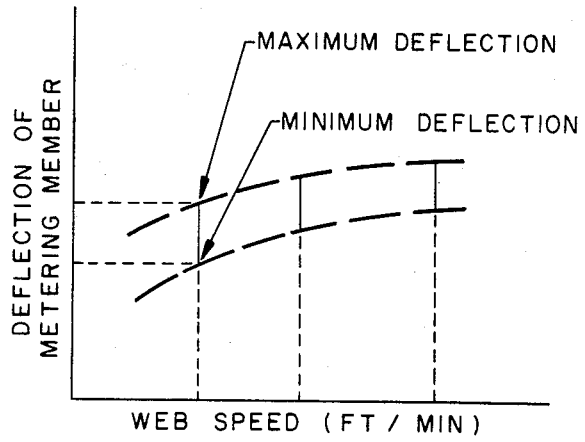
FIG. 14 is a graph diagrammatically illustrating variation in position of an edge on the metering member relative to the axis of a resilient covered transfer roll when driven at a constant or variable speed.
Figure 15:
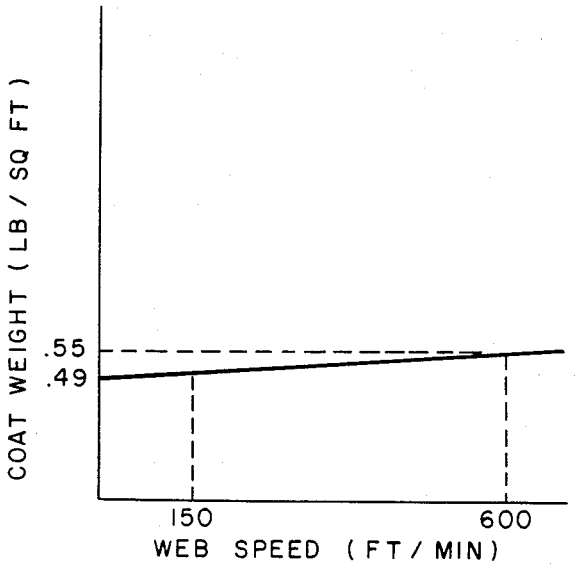
FIG. 15 is a graph diagrammatically illustrating that coat weight is independent of web speed.

As diagrammatically illustrated in FIG. 14 of the drawing, metering edge 90 on metering member 75 is supported on the unsupported end of a cantilever beam and moves in a radial direction relative to the axis of roll 35 as roll 35 rotates. When metering member 75 is mounted as described hereinbefore, the body of metering member 75 acts as a spring to resiliently urge metering edge 90 into indented relation with the surface of roll 35. As illustrated in FIG. 14, metering edge 90 moves away from the axis of roll 35 as the surface speed of roll 35 is increased and oscillates relative to the axis of roll 35 on each revolution of roll 35.

When metering edge 90 and trailing edge 98 are positioned and supported as hereinbefore described, metering member 75 is rigid in a tangential direction and is resiliently supported in a radial direction. This permits movement of metering edge 90 relative to the surface of applicator roll 35 to provide automatic consistency and uniformity of metering as roll by roll 35 past metering edge 90 and a portion upwardly to assure that no significant hydraulic pressure will move metering edge 90 relative to roll 35. This creates counter flow of coating in the reservoir to prevent movement of foreign matter to edge 90.

When the surface speed of transfer roll 35 was changed, during testing, from 150 feet per minute to 600 feet per minute the coat weight increased very slightly from 0.49 pounds per 3,000 square feet at 150 feet per minute to 0.55 pounds per 3,000 square feet at 600 square feet per minute. Apparatus employed for measuring the coat weight is commercially available from General Electric Company, Silicone Products Division, Watertown, N.Y. The particular coating applied during the test is commercially available from General Electric Company and is distributed as "SL 4400" with "SS 4300C" Cross-linker (catalyst). The coating material was formed by mixing 100 parts "SL 4400" silicone with five parts "SS 4300C" Cross-linker (catalyst). The angle Al between metering surface 92 and support surface 94 on metering member 75 was 130° and the distance between metering edge 90 and trailing edge 98 was 0.125 inches.

The web was 40 pounds per 3,000 square feet high density Kraft release paper. The web width was 22 inches and the web tension was one pound per linear inch.

Silicone polymer which is suitable for application in the coater apparatus hereinbefore described is commercially available from a number of sources including General Electric Company. One product available as "Solventless silicone polymer SS 4300" is a 100% solids reactive polymer of polydimethylsiloxane found useful as a release coating for paper, available as "Solventless silicone polymer SS 4300" is a 100% solids reactive polymer of polydimethylsiloxane found useful as a release coating for paper, foil and certain plastic substrates without solvent dilution. "SS 4300" is available in two viscosity grades, 425 cps. and 1,000 cps., identified as SS 4300 and SS 4300-10, respectively. Either viscosity may be coated solventless to obtain uniform continuous coatings. They may also be blended to give any intermediate viscosity to obtain an optimum balance between hold-out and leveling for various substrates. The products has been used as release coatings for pressure sensitive adhesives used in label and tape applications.

According to data supplied by General Electric, "SS 4300" comprises 100% active solids, at a specific gravity of 0.97, a density of 8.09 pounds per gallon and an average viscosity of 425 cps. at 25° centigrade.

"SS 4300-10" comprises 100% active solids, has a specific gravity of 0.97 and a density of 8.09 pounds per gallon and an average viscosity of 950 cps. at 25° centrigrade.

"SS 4300C" comprises 100% active solids and has a specific gravity of 0.99, a density of 8.25 pounds per gallon and a viscosity of 20 cps. at 25° centigrade. A product available from General Electric as "SS 4305 solventless silicone control release polymer" is a solventless paper release coating intended for use with General Electric SS 4300 silicone release coating to provide a range of controlled release against certain types of pressure sensitive adhesives.

General Electric "SS 4300" solventless paper release coating may provide release values too low for some applications. The addition of General Electric SS 4305 to a "SS 4300" coating bath increases the release values proportional to the amount of SS 4305 employed. Cure and abrasion resistance of SS 4300 has not been found to be affected by the addition of "SS 4305." The manufacturer indicates that for any given adhesive, the more SS 4305 used, the higher the resulting release values. General Electric suggests that the proper level of SS 4305 can best be determined by testing several levels until the desired release value is obtained. The suggested starting formulas might comprise 75 parts "SS 4300"; 25 parts "SS 4305" and five parts "SS 4300C."

The silicone coating material described above have a shelf life of about 12 months when stored at 77° Fahrenheit (25° centigrade) in their original unopened containers.

Having described our invention, we claim:

1. A method of forming a thin continuous glaze on a web substrate comprising the steps of: positioning a transfer roll having a smooth resilient surface and a metering member having a flat metering surface and a metering edge in pressure indented relation to form a metering wedge; depositing a mixture of liquid silicone reactive polymer and a cross-linker on the smooth resilient roll surface; rotating the resilient roll to move a portion of the mixture of liquid silicone reactive polymer and cross-linker through the metering wedge to form a metered film of liquid and to transfer the film of liquid directly to a web substrate; moving a web substrate in engagement with the resilient transfer roll surface and at substantially the same surface speed as the resilient roll surface; urging a backup roll into engagement with the web such that the resilient surface on the transfer roll is deformed by the web to apply a continuous glaze of the mixture of liquid silicone reactive polymer and cross-linker to the surface of the web substrate; and controlling the indentation of the metering edge into the resilient roll surface to control the thickness of the glaze of liquid applied by the transfer roll to the web to a range between one-tenth and one pound per 3,000 square feet.

2. The method of claim 1 with the additional step of: cooling the mixture of liquid silicone reactive polymer and cross-linker adjacent the metering wedge to maintain the temperature of the liquid below 100° Fahrenheit.

3. The method of claim 1 with the additional step of: heating the web and the glaze of liquid silicone reactive polymer and cross-linker to a temperature of at least 175° Fahrenheit to crosslink molecules of the liquid glaze.

4. The method of claim 1 with the additional step of: adjusting pressure exerted by the metering roll and the backup roll to the web substrate to maintain minimum indentation of the resilient metering roll surface while maintaining sufficient contact with the web substrate to form a continuous glaze over the entire surface of the web substrate.

5. The method of claim 1 wherein the mixture of liquid silicone reactive polymer and cross-linker comprises: a 100% silicone reactive polymer of polydimethylsiloxane formulated to be cross-linked with a cross-linker when exposed to temperature in a range between 175° Fahrenheit and 550° Fahrenheit for a period of time of less than 20 seconds.

6. The method of claim 1 wherein the liquid silicone reactive polymer comprises: a 100% solids reactive polymer of polydimethylsiloxane and a solventless paper release coating to provide a range of control release against pressure sensitive adhesives mixed to form 100 parts of material, the mixture being mixed with between three and five parts cross-linker, the mixture being formulated to be cross-linked when heated to a temperature between 175° and 550° Fahrenheit for a period of less than 20 seconds.

7. The method of claim 1 wherein the web substrate comprises paper.

8. The method of claim 1 wherein the web substrate comprises plastic material.

9. The method of claim 1 wherein the web substrate comprises high density kraft release paper.

10. The method of claim 1 wherein the metering surface is shaped and oriented relative to the resilient transfer roll surface such that a substantially constant liquid film thickness is maintained on the transfer roll surface when the surface speed of the transfer roll is changed within a speed range of less than 1,500 feet per minute.

11. The method of claim 1 with the addition of the step of: circulating the liquid in heat exchange relation with a heat exchanger to maintain the temperature of the liquid less than 75° Fahrenheit.

12. The method of claim 1 with the addition of the step of: adjusting the indentation of the metering edge into the roll surface to adjust the thickness of the glaze.

* * * * *

UNITED STATES PATENT AND TRADEMARK OFFICE

CERTIFICATE OF CORRECTION

PATENT NO. : 4,533,563

DATED : August 6, 1985

INVENTOR(S) : Harold P. Dahlgren; John W. Gardiner; James E. Taylor

It is certified that error appears in the above-identified patent and that said Letters Patent is hereby corrected as shown below:

Column 11, line 2, change "0.0070" to -- 0.070 --

Column 12, line 47, change "smooting" to -- smoothing --

Signed and Sealed this

*Fifth* Day of *November 1985*

[SEAL]

*Attest:*

DONALD J. QUIGG

*Attesting Officer*

*Commissioner of Patents and Trademarks*